US005570819A

United States Patent [19]

Uehira et al.

[11] Patent Number: 5,570,819

[45] Date of Patent: Nov. 5, 1996

[54] FOAM DISPENSING PUMP CONTAINER

[75] Inventors: Shoji Uehira, Joyo; Takashi Miyagi, Yokohama, both of Japan

[73] Assignee: Daiwa Can Company, Japan

[21] Appl. No.: 623,513

[22] Filed: Mar. 28, 1996

Related U.S. Application Data

[63] Continuation of Ser. No. 131,407, Oct. 1, 1993, abandoned, which is a continuation-in-part of Ser. No. 910,100, Jul. 7, 1992, Pat. No. 5,271,530.

[51] Int. Cl.[6] ..... B67D 5/06

[52] U.S. Cl. ..... 222/190; 222/321.9; 222/255

[58] Field of Search ..... 239/333, 243, 239/153; 222/189.11, 190, 321.1, 321.7, 321.9, 384, 385, 255, 321.2

[56] References Cited

U.S. PATENT DOCUMENTS

| | | | |
|---|---|---|---|
| 3,191,814 | 6/1965 | Corsette et al. | 222/384 |
| 4,219,159 | 8/1980 | Wesner | 239/343 |
| 4,496,085 | 1/1985 | Ford et al. | 222/321 |
| 4,512,501 | 4/1985 | Foster | 222/321 X |
| 5,071,379 | 12/1991 | Poizot | 222/464 |
| 5,271,530 | 12/1993 | Uehira et al. | 222/321 X |

FOREIGN PATENT DOCUMENTS

| | | |
|---|---|---|
| 0196737 | 10/1986 | European Pat. Off. . |
| 5428709 | 10/1977 | Japan . |
| 582459 | 11/1977 | Japan . |
| 53-40404 | 4/1978 | Japan . |
| 5720285 | 9/1978 | Japan . |
| 5823415 | 9/1978 | Japan . |
| 57-20285 | 8/1982 | Japan . |
| 61-141 | 1/1986 | Japan . |
| 60-27475 | 6/1987 | Japan . |
| 62-101747 | 6/1987 | Japan . |
| 62-177653 | 11/1987 | Japan . |
| 63-21250 | 2/1988 | Japan . |
| 63-23251 | 2/1988 | Japan . |
| 63-13810 | 4/1988 | Japan . |
| 2-237671 | 9/1990 | Japan . |

*Primary Examiner*—Andres Kashnikow
*Assistant Examiner*—Kenneth Bomberg
*Attorney, Agent, or Firm*—Merchant, Gould, Smith, Edell, Welter & Schmidt

[57] ABSTRACT

A foam dispensing, pump-actuated container to mix air and a liquid at a predetermined ratio has a mixing chamber at a juncture of a liquid flow path and an air flow path from an air cylinder, and the foam is homogenized by a porous sheet-like member provided on the downstream of the mixing chamber, and then dispensed through the dispenser nozzle. A liquid cylinder extends downwardly relative to the bottom surface of the air cylinder, so that a slidable portion of an air piston and a slidable portion of a liquid piston, both constituting the piston assembly of the foam dispensing pump, are set at different elevations for reciprocal movement. A check valve is provided in the air piston so that outer air is introduced into an air chamber defined by the air cylinder and the air piston through a gap around the outer circumferential surface of the air piston. The dispenser nozzle threadably engages the container such that the liquid in the container is sealed when the dispenser nozzle is threadably engaged with the container.

11 Claims, 12 Drawing Sheets

FIG. 12

| 18a \ 18b | 0.16 (12.2) | 0.10 (10.7) | 0.04 (15.9) | 0.015 (14.0) | 0.007 (10.9) | 0.0036 (9.4) | 0.0023 (8.8) | 0.0015 (6.8) | 0.0007 (5.5) |
|---|---|---|---|---|---|---|---|---|---|
| 0.16 (5.9) | × / × | × / × | × / × | × / × | × / × | △ / × | △ / × | △ / × | △ / × |
| 0.10 (5.2) | × / × | × / × | × / △ | △ / △ | △ / △ | △ / △ | ○ / △ | ○ / △ | ○ / △ |
| 0.04 (7.7) | × / × | × / × | × / △ | △ / ○ | ○ / ○ | ○ / ○ | ○ / ○ | ○ / ○ | ○ / ○ |
| 0.015 (6.8) | × / × | × / × | × / × | △ / × | ○ / △ | ○ / ○ | ○ / ○ | ○ / ○ | ○ / ○ |
| 0.007 (5.3) | × / × | × / × | △ / × | △ / × | ○ / × | ○ / △ | ○ / ○ | ○ / ○ | ○ / ○ |
| 0.0036 (4.5) | × / × | × / × | △ / × | △ / × | ○ / × | ○ / × | ○ / △ | ○ / ○ | ○ / ○ |
| 0.0023 (4.3) | × / × | × / × | △ / × | ○ / × | ○ / × | ○ / × | ○ / × | ○ / △ | ○ / ○ |
| 0.0015 (3.3) | × / × | △ / × | ○ / × | ○ / × | ○ / × | ○ / × | ○ / × | ○ / × | ○ / △ |
| 0.0007 (2.7) | × / × | △ / × | ○ / × | ○ / × | ○ / × | ○ / × | ○ / × | ○ / × | ○ / × |

FIG. 13

| DISTANCE (mm) | UNIFORMITY |
|---|---|
| 5 | × |
| 8 | × |
| 10 | △ |
| 12 | ○ |
| 15 | ○ |
| 20 | ○ |
| 50 | ○ |
| 60 | ○ |

FOAM DISPENSING PUMP CONTAINER

This is a Continuation of application Ser. No. 08/131,407, filed Oct. 1, 1993, now abandoned, which is a Continuation in part of application Ser. No. 07/910,100 filed Jul. 7, 1992, now issued as U.S. Pat. No. 5,271,530.

TECHNICAL FIELD

The present invention relates to a foam dispensing pump container for foaming a foamable liquid, e.g., a detergent, hand soap, or shampoo, by mixing it with air, and thereafter homogenizing the foam and dispensing it a small amount at a time.

BACKGROUND ART

Conventionally, foam dispensing pump containers based on the method of storing a high-pressure gas, e.g., a carbon dioxide gas and a Freon gas, in a container together with a foamable liquid for creating foam upon dispensing are in wide and practical use. With the growing public consciousness for the global environment in these years, however, there have been apparent moves for totally banning use of such kinds of high-pressure gases in an attempt to protect the global atmosphere. Accordingly, demands have arisen for a foam dispensing pump container not using the high-pressure gas.

Japanese Utility Model Registration No. 1529456 (Japanese Utility Model Publication No. 58-23415) discloses a typical example of a foam dispensing pump container not using a high-pressure gas. The proposed arrangement according to this disclosure may be briefed as follows. That is, this foam dispensing pump container comprises a double cylinder which is provided at an opening portion of a container containing a liquid and which is constituted by air and liquid cylinders that are concentrically provided, a dip tube for allowing a bottom portion of the liquid cylinder and a bottom portion of the container to communicate with each other, a piston assembly constituted by air and liquid pistons integrally provided and movable up and down in the air and liquid cylinders, respectively, a nozzle member provided at an upper end of the piston assembly and having a foam dispensing hole portion, an air flow path for allowing the hole portion and the air cylinder to communicate with each other, a liquid flow path for allowing the liquid cylinder and the hole portion to communicate with each other, a first check valve disposed midway along the liquid flow path, a second check valve disposed in the liquid cylinder, a compression spring for urging the piston assembly to a top dead point with respect to the double cylinder, a lid member for fixing the double cylinder to the container and defining the air cylinder to guide insertion of the piston assembly therethrough, and an interposed permeable object or a porous member, e.g., a sponge, having a function of introducing outer air and generating and discharging foam at a juncture of the air flow path and the liquid flow path in the hole portion.

With the above arrangement, when the piston assembly moves up and down, the liquid supplied from the liquid cylinder and air supplied from the air cylinder are mixed in the interposed permeable object to generate foam and dispense it through the hole portion of the nozzle member.

However, the aforementioned interposed permeable object of this proposal has the first problem in that, since it has has two functions, i.e., a function of introducing the outer air into the air cylinder and a function of generating and discharging the foam, the fluid resistance upon introduction of the outer air essentially becomes large enough to disturb smooth reciprocal movement of the piston assembly. The interposed permeable object also has a second problem. That is, the liquid component of the foam remaining in the interposed permeable object gets dry and solidified in it thereby, causing clogging.

Japanese Utility Model Registration No. 1467526 (Japanese Utility Model Publication No. 57-20285), which is filed by the same applicant as Japanese Utility Model Registration No. 1529456 described above, proposes another foam dispensing pump container not using a high-pressure gas. According to this second proposal, the double cylinder in the arrangement of above Japanese Utility Model Registration No. 1529456 is provided with the liquid cylinder which stands at the central portion of the bottom portion of the air cylinder, an outer air inlet hole having an operational valve is formed in the air cylinder to allow the liquid in the container to communicate with outer air outside the container in order to prevent the interior of the container from being set at a negative pressure, and the skirt portion of the air piston which slides on the inner surface of the air cylinder is formed thin.

However, the second proposal does not clearly describe a means for introducing outer air into the air cylinder and if the same arrangement as the first proposal is in use, it still has the same problems. Also, if the skirt portion of the air piston which slides on the inner surface of the air cylinder is to be formed thin so that the skirt portion is deformed inward when the interior of the air cylinder is set at the negative pressure, thereby introducing outer air into the air cylinder, high precise slidable contact between the air cylinder and the air piston must be maintained.

Even if such precise sliding contact is obtainable, sufficient air supply cannot be attained when the piston is slightly inclined while it is moved downward, and as a result, the quantity of air supplied to the interposed permeable object essentially varies and a constant mixing ratio of the air and liquid cannot be maintained.

DISCLOSURE OF INVENTION

The present invention has been made in view of the problems described above, and has an object to provide a foam dispensing pump container for dispensing foam by a manual pumping operation, wherein the introduction of outer air to generate foam takes place with a minimum of resistance so as to ensure smooth reciprocal movement of the piston assembly, a porous member employed for generating the foam may not be clogged by dry and solidified liquid component of the residued foam and the quantity of air introduced into the air cylinder is kept constant at all times to maintain a given mixing ratio of air and the liquid.

It is another object of the present invention to provide a foam dispensing pump container capable of threadably engaging a nozzle member with a lid member to close the container hermetically while the container is in transit or storage.

It is still another object of the present invention to provide a foam dispensing pump container which can prevent a "non-foaming operation" in which only the liquid is dispensed in the use of the container, an "idling operation" in which no liquid is dispensed in the use of the container, and "liquid leakage", i.e., leaking of the liquid when the container is left to stand, by reliably preventing a change in internal pressure of the container even with a rapid change in ambient temperature.

It is still another object of the present invention to provide a foam dispensing pump container which can dispense fine uniform foam even if the liquid in the container has a high viscosity of 10 centipoise (10 cp) or more.

In order to achieve the above objects, a foam dispensing pump container according to the present invention comprises a double cylinder which is provided inside an opening portion of a container containing a liquid and which is constituted by an air cylinder for air pumping and a liquid cylinder for pumping liquid, both arranged concentrically, a dip tube for allowing a bottom portion of the liquid cylinder and a bottom portion of the container to communicate with each other, a piston assembly constituted by air and liquid pistons, both arranged concentrically and integrally to move up and down in the air and liquid cylinders respectively, a nozzle member provided at an upper end of the piston assembly and having a foam dispensing hole portion, an air flow path for allowing the hole portion and an interior of the air cylinder to communicate with each other, a liquid flow path for allowing an interior of the liquid cylinder and the hole portion to communicate with each other, a first check valve disposed midway along the liquid flow path, a second check valve disposed in the liquid cylinder, a porous member disposed in the hole portion, a compression spring for urging the piston assembly to a top dead point with respect to the double cylinder, an outer air inlet hole formed in the air cylinder to allow the liquid in the container and an outer air outside the container to communicate with each other and prevent the interior of the container from being set at a negative pressure and having an operational valve, and a lid member for fixing the double cylinder to the container and guiding insertion of the piston therethrough. Wherein the porous member is constituted by a porous sheet-like member, a juncture where the liquid flow path and the air flow path join with each other is provided in the upstream of the porous sheet-like member and serves as a mixing chamber for mixing the liquid and air, the liquid cylinder extends downwardly from a bottom surface of the air cylinder so that a slidable portion of the air piston and a slidable portion of the liquid piston of the piston assembly move up and down at different elevations and a third check valve is provided in the air piston so that outer air is introduced into an air chamber, defined by the air cylinder and the air piston, through an insertion gap between an outer circumferential surface of the air piston and an insertion hole of the lid member.

In order to achieve the above objects, a foam dispensing pump container accordingly to the present invention comprises a double cylinder which is provided inside an opening portion of a container containing a liquid and which is constituted by an air cylinder for pumping air and a liquid cylinder for pumping liquid, both arranged concentrically, a dip tube for allowing a bottom portion of the liquid cylinder and a bottom portion of the container to communicate with each other, a piston assembly constituted by air and liquid pistons, both arranged concentrically and integrally to move up and down in the air and liquid cylinders respectively, a nozzle member provided at an upper end of the piston assembly and having a foam dispensing hole portion, an air flow path for allowing the hole portion and an interior of the air cylinder to communicate with each other, a liquid flow path for allowing an interior of the liquid cylinder and the hole portion to communicate with each other, a first check valve disposed midway along the liquid flow path, a second check valve disposed in the liquid cylinder, a porous member disposed in the hole portion, a compression spring for urging the piston assembly to a top dead point with respect to the double cylinder, an outer air inlet hole formed in the air cylinder to allow the liquid in the container and outer air outside the container to communicate with each other and prevent the interior of the container from being set at a negative pressure and having an operational valve, and a lid member for fixing the double cylinder to the container and guiding insertion of the piston assembly therethrough. Wherein the porous member is constituted by a porous sheet-like member, a juncture where the liquid flow path and the air flow path join with each other is provided in the upstream of the porous sheet-like member and serves as a mixing chamber for mixing the liquid and air, the liquid cylinder extends downwardly from a bottom surface of the air cylinder so that a slidable portion of the air piston and a slidable portion of the liquid piston of the piston assembly move up and down at different elevations, a third check valve is provided in the air piston so that outer air is introduced into an air chamber, defined by the air cylinder and the air piston, through an insertion gap between an outer circumferential surface of the air piston and an insertion hole of the lid member.

An externally threaded portion is formed on the outer circumferential surface of the air piston in the vicinity of the nozzle member and an internally threaded portion is formed on the lid member to threadably engage with the external thread portion, such that a threadable engagement of the air piston and the lid member is maintained against repelling force of the compression spring.

Other features and advantages of the present invention will be apparent from the following description taken in conjunction with the accompanying drawings, in which like reference characters designate the same or similar parts throughout the figures thereof.

BRIEF DESCRIPTION OF DRAWINGS

FIG. 12 is a chart showing the relationship between the area of each pore of the porous sheet-like member and the foaming properties; and FIG. 13 is a chart showing the relationship between the distance between two porous sheet-like members and the uniformity of foam.

MOST PREFERRED EMBODIMENTS OF THE INVENTION

Figure 1:
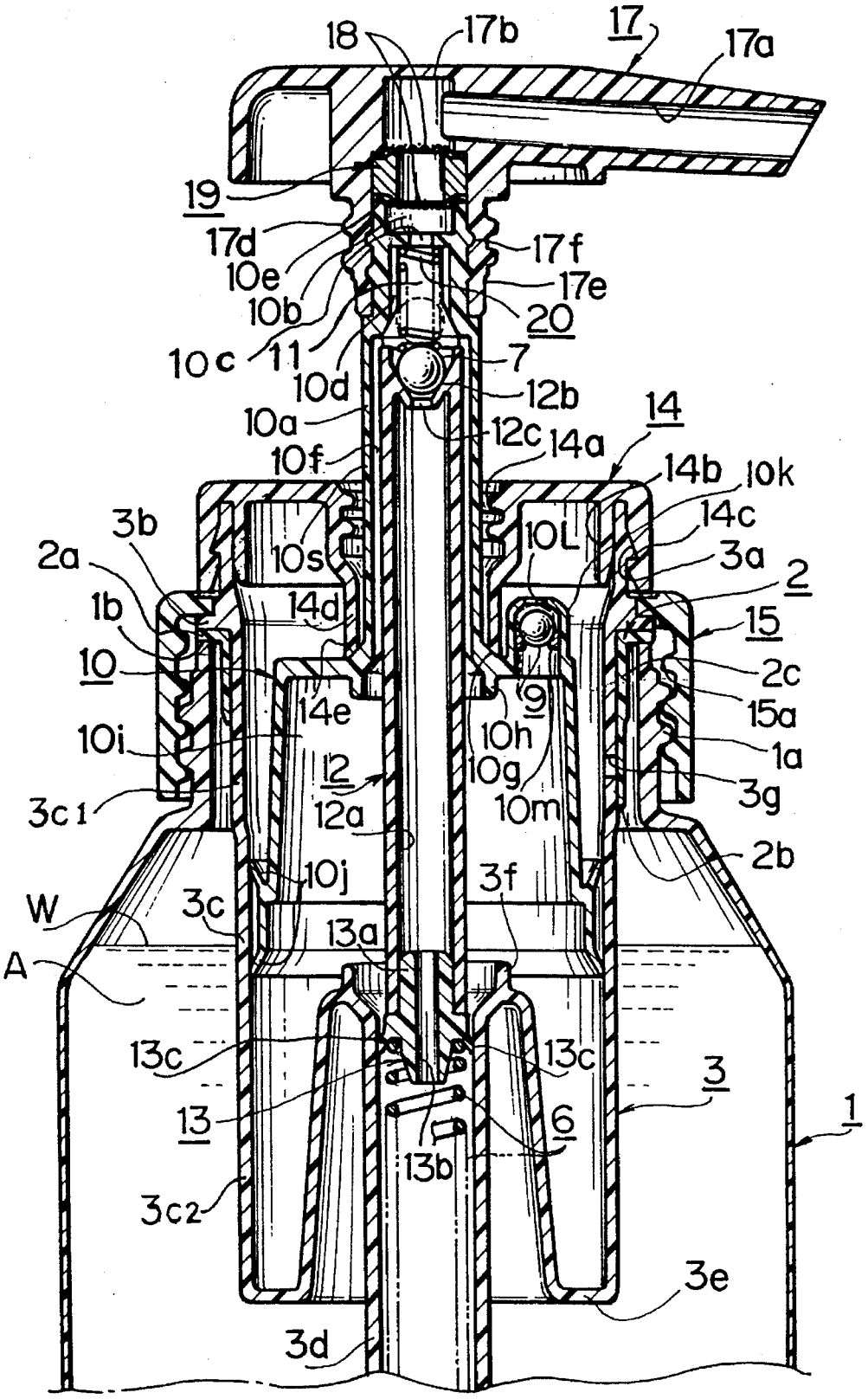
FIG. 1 is a longitudinal sectional view showing an upper portion of a foam dispensing pump container according to the first embodiment.
Figure 2:
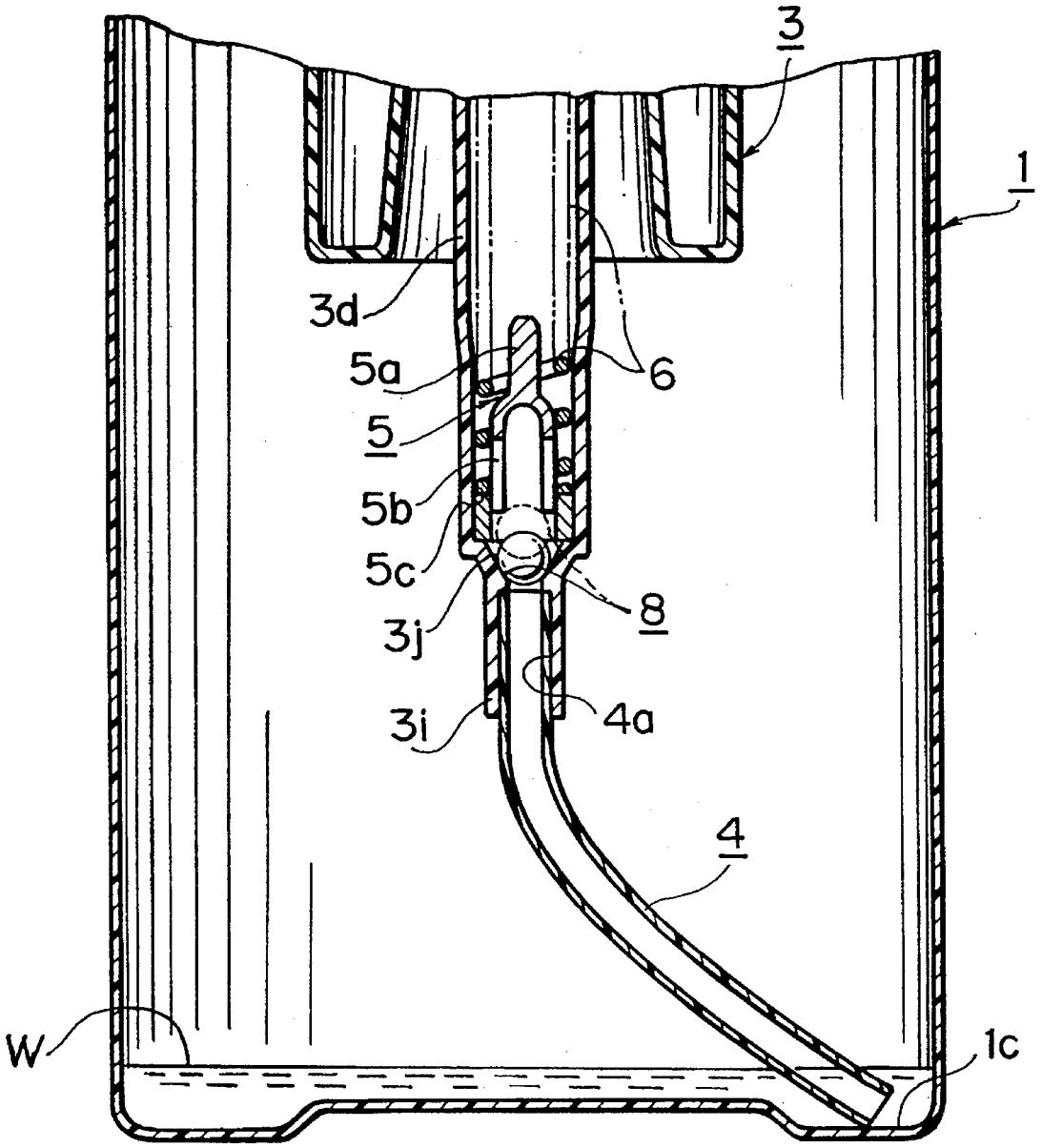
FIG. 2 is a longitudinal sectional view showing a lower portion of the foam dispensing pump container according to the first embodiment.

The first embodiment of a foam dispensing pump container according to the present invention will be described in two portions, an upper half and a lower half. FIG. 1 is a longitudinal sectional view showing the upper portion of the foam dispensing pump container, and FIG. 2 is a longitudinal sectional view showing the lower portion of the foam dispensing pump container.

Referring to FIG. 1, a cylindrical container 1, formed by, e.g., blow molding a resin or the like, carries, up to its maximum fill level W, a formable liquid A to which a surfactant or the like is added to impart foaming properties when mixed with air. An opening thread portion la having an externally threaded portion is integrally formed on the outer circumferential end portion of the upper opening portion of the container 1. When an inner thread portion 15*a*, which is an internally threaded portion of a large lid member 15, is held engaged with the opening thread portion 1*a*, the hermetic state of the container is maintained, and also, a complete pump assembly to be described later is fastened to the container 1.

The construction of the pump assembly will be described. The cylinder portion of the pump assembly is injection-molded from, e.g., a polypropylene resin and is constituted as a double cylinder 3 in which two cylinders, a large air cylinder 3*c* and a small liquid cylinder 3*d*, respectively, are concentrically formed, as shown in FIG. 1. The double cylinder 3 is open upward, and an annular fitting portion 3*a* having a locking portion inserted under pressure in and locked with a small lid member 14 and a flange portion 3*b* serving as a portion to be fastened to the container 1 are annularly formed on the open end portion of the double cylinder 3. Accordingly, the assembly as shown in FIG. 1 is obtained by assembling the respective components, to be described later, in the double cylinder 3, then fitting the aforesaid large lid member 15 to the flange portion 3*b* of the double cylinder 3, and finally pressing the annular fitting portion 3*a* until it is locked in a space between an outer wall locking portion 14*c* and an inner wall portion 14*b* of the small lid member 14, injection-molded from, e.g., a colored polypropylene resin, to form an integral assembly, so that the large lid member 15 may not come off from the pump assembly.

The double cylinder 3 has the annular fitting portion 3*a*, the flange portion 3*b*, the air cylinder portion 3*c*, and the liquid cylinder portion 3*d*, as shown in FIG. 1, wherein the air cylinder 3*c* is continuous from the flange portion 3*b*, and has an outer diameter slightly smaller than the inner diameter of the opening thread portion 1*a* of the container 1 and a substantially cylindrical shape. The liquid cylinder portion 3*d* is connected with the air cylinder portion 3*c* at the central portion of a bottom portion 3*e* of the air cylinder portion 3*c*, and has a substantially cylindrical shape concentric with the air cylinder portion 3*c* and a diameter smaller than that of the air cylinder portion 3*c*.

The double cylinder 3 will be described in more detail. The air cylinder portion 3*c* consists of a cylindrical portion constituted by a cylindrical guide portion $3c_1$ having an inner diameter smaller than that of the annular fitting portion 3*a* and a cylinder portion $3c_2$ connected with the cylindrical guide portion $3c_1$ through a taper portion and having an inner diameter smaller than that of the cylindrical guide portion $3c_1$, and a bottom portion 3*e* extending inwardly in the radial direction from the lower end of the cylinder portion $3_{c2}$ and having an upwardly inverted central portion. The liquid cylinder portion 3*d* is connected with the upper end of the inverted portion of the bottom portion 3*e* of the air cylinder portion 3*c* where a projecting seal portion 3*f* to be described later is formed, then extends downwardly from this connecting portion and terminates at its lower end with a reduced diameter.

Regarding the dimensional relationship among the inner diameters of the annular fitting portion 3*a*, the cylindrical guide portion $3c_1$, and the cylinder portion $3c_2$, and the outer diameter of a slidable seal portion 10*j* of an air piston 10 to be described later, the inner diameter of the annular fitting portion 3*a* is larger than the outer diameter of the slidable seal portion 10*j*, the inner diameter of the cylindrical guide portion $3c_1$ is substantially equal to the outer diameter of the slidable seal portion 10*j*, and the inner diameter of the cylinder portion $3c_2$ is slightly smaller than the outer diameter of the slidable seal portion 10*j*. The inner surface portions having different inner diameters are connected by taper portions. In the aforesaid arrangement, when an assembly of the air piston 10 and the liquid piston 12 is inserted in the corresponding cylinders, the liquid cylinder portion 3*d* and the liquid piston 12 are automatically aligned with each other simply by bringing down the slidable seal portion 10*j* of the air piston 10 through the annular fitting portion 3*a*, the flange portion 3*b*, the cylindrical guide portion $3c_1$, and the cylinder portion $3c_2$ so that the insertion is readily done and in addition, damage to slidable portions of the respective pistons that may be caused during such insertion can be eliminated.

The mixing ratio of the liquid to air is governed basically by the volumetic ratio of the air cylinder portion 3*c* to the liquid cylinder portion 3*d*, and to generate desired foam, the quantity of air must be sufficiently larger than that of the liquid. On the other hand, if an overall length of the double cylinder 3 is made excessively large, the container 1 must also be made tall enough to match such length. Therefore, the double cylinder is designed such that the central portion of the bottom portion 3*e* of the air cylinder portion 3*c* is inverted upward, and the liquid cylinder portion 3*d* is connected to the upper end portion of such inverted portion.

While the liquid cylinder portion 3*d* extends downwardly from the bottom portion 3*e* of the air cylinder portion 3*c*, the slidable seal portion 10*j* of the air piston 10 and a slidable seal portion 13*c* (to be described later) of the liquid piston 12 are set at different elevations. Hence, these freely slidable pistons are supported at least at two points, i.e., upper and lower, to enhance prevention of their tilting and waddling.

The annular projecting seal portion 3*f* is formed on the reverse side of the connecting portion connecting the liquid cylinder portion 3*d* with the air cylinder portions 3*c* so as to project upwardly in the air cylinder portion 3*c*. For transportation or storage, an air piston to be described later is sealingly fitted to the projecting seal portion 3*f* to maintain the hermetic state. Furthermore, the inner circumferential surface of the projecting seal portion 3f is formed to have a conical shape portion which continues to the inner circumferential surface of the liquid cylinder portion 3d, as shown in FIG. 1. Hence, a slidable seal member 13 to be described later can be smoothly inserted and assembled in the liquid cylinder portion 3d without interruption.

An outer air inlet hole portion 3g for introducing outer air into the container 1 through the aforesaid inner thread portion 14a of the small lid member 14 is formed in the cylindrical guide portion $3c_1$ of the air cylinder portion 3c. As the foamable liquid A is consumed, outer air of a volume equivalent to a volume of consumption of the liquid A is introduced into the container 1 through the outer air inlet hole portion 3g (see the right hand side portion of FIG. 1), so that the interior of the container 1 is prevented from being set at a negative pressure. An annular seal member 2 made of a soft resin is interposed between the flange portion 3b of the double cylinder 3 and an opening end portion 1b of the container 1 to maintain the hermetic state. The seal member 2 consists of a seal portion 2a, a thin tongue portion 2b, and an annular portion 2c. The seal portion 2a serves as a gasket to maintain the hermetic state when the large lid member 15 is threadably engaged with the container 1. The tongue portion 2b serving as a valve member to close the outer air inlet hole portion 3g is formed on part of the seal member 2 in such a manner that it is urged against the air cylinder 3. The annular portion 2c is fitted to the outer circumferential surface of the upper portion of the cylindrical guide portion $3c_1$ of the air cylinder portion 3c. The tongue portion 2b is elastically deformed to open only when outer air is introduced as described above, other than that, it always closes the outer air inlet hole portion 3g so that the liquid A may not leak into the air cylinder 3c through the outer air inlet hole portion 3g while the container is in transit or kept in stock.

Referring now to FIG. 2, part of a bottom portion 1c of the container 1 is formed deeper to enhance both ability to stand upright stably and rigidity of the container 1 as is conventionally known, and also to ensure that the liquid A can be completely drawn through a hollow dip tube 4 even when the foamable liquid A is consumed until the liquid level W goes down as shown in FIG. 2.

The liquid cylinder 3d of the double cylinder 3 is formed to extend downwardly and terminate with a lower hole portion 3i having a small diameter. An upper end 4a of the dip tube 4 is pressure-fitted into the lower hole portion 3i. A ball seat 3j is formed on the inner surface of a stepped portion between the lower hole portion 3i and the liquid cylinder 3d, and a second ball 8 made of a stainless steel or the like and having high corrosion resistance is seated on the ball seat 3j in such manner that the ball is freely movable between a position shown by the solid line and the position shown by the broken line. Furthermore, a plug member 5 is provided in the liquid cylinder 3d and placed over the ball seat 3j, as shown in FIG. 2. The plug member 5 restricts movements of the second ball 8 beyond the position shown by the broken line, and has an annular seat portion 5c to receive a coil spring 6 which gives repelling force to a dispenser nozzle member (to be described later) when the dispenser nozzle member is pressed down. A plug portion 5a is formed on the head portion of the plug member 5. During transportation or storage, the plug portion 5a is fitted in a liquid guide hole portion 13b of the slidable seal member 13 of the piston, so that leakage of the liquid A is eliminated. An opening portion 5b is formed between the plug portion 5a and the seat portion 5c, and when the second ball 8 is moved to the position indicated by the broken line, the liquid A is allowed into the liquid cylinder portion 3d through the opening portion 5b.

Referring again to FIG. 1, a portion of the pump assembly serving as the piston are moved up and down integrally in the air and liquid cylinder portions 3c and 3d of aforesaid double cylinder 3. For this purpose, the air piston 10 is of a hat-like construction constituted by a pair of upper and lower slidable seal portions 10j and an air chamber portion 10i. The slidable seal portion 10j ensures adequate sealing contacts when the air piston 10 slides vertically along the inner wall surface of the air cylinder portion 3c (or more specifically, the inner wall surface of the cylinder portion $3c_2$). In addition, a hollow rod portion 10a is formed integrally with the air piston 10 to extend upwardly from the central portion of the air chamber portion 10i. Also, as is apparent from FIG. 1, the slidable seal portions 10j of the air piston 10 contact the inner wall surface of the air cylinder portion 3c at two points, upper and lower, so that the desired hermetic state can be maintained even if a user depresses the air piston 10 obliquely, and as a result, a predetermined mixing ratio of the air to liquid can be maintained.

The liquid piston 12 is pressure fitted in and integrally fixed to the air piston 10 so that they are movable integrally. The liquid piston 12 is constituted by a cylindrical member (as shown in FIG. 1) to guide the liquid to its interior. The liquid piston 12 has a ball seat 12b at its upper portion for holding a first ball 7, and an opening portion 12c communicating with a liquid guide portion 12a.

Figure 4:
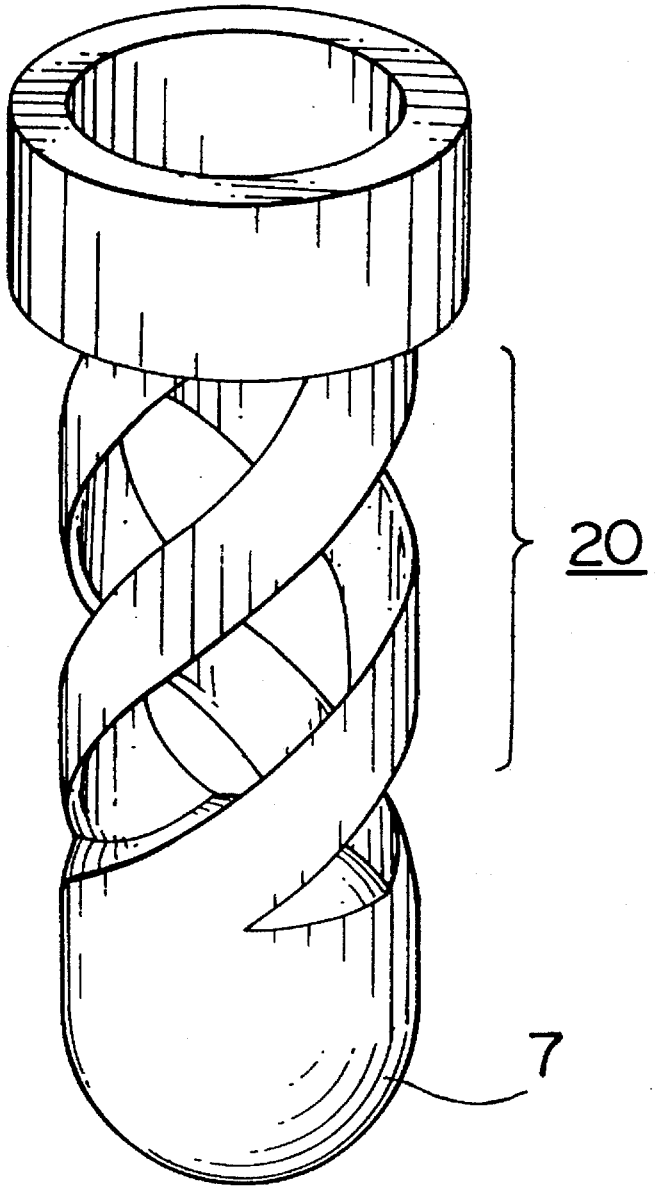
FIG. 4 is an external view of an integrally molded first ball and coil spring.

The first ball 7 is held at the position indicated by the solid line by means of a small coil spring 20. When operated as will be described later, the first ball is urged by the pressure of the liquid A in the liquid guide portion 12a and the small coil spring 20 is compressed so that the first ball 7 moves to a position indicated by a broken line to cause the opening portion 12c and a mixing chamber 11 to communicate with each other. As a result, the liquid is fed into the mixing chamber 11. The first ball 7 may be seated on the ball seat 12b by its own gravity but by providing the small coil spring 20 leakage of the liquid is prevented when the container 1 is tipped over. The first ball 7 may be formed integrally with the small coil spring 20 to a configuration as shown in FIG. 4 showing an integrally molded first ball and the coil spring.

A pressure fitted portion 13a of the slidable member 13 having the slidable seal member 13c which moves up and down sealingly in the liquid cylinder 3d is inserted in the lower end of the liquid piston 12, as shown in FIG. 1. The slidable member 13 has the liquid guide hole portion 13b which fits to the aforesaid plug portion 5a of the plug member 5 to maintain the hermetic state and also serves as a flow path through which the liquid is introduced. The upper end of the aforesaid coil spring 6 is abutted against the lower side of the slidable seal portion 13c to urge the integral assembly of the air and liquid pistons 10 and 12 to the position shown in FIG. 1.

A dispenser nozzle member 17 is pressure fitted in and fixed integrally to an end portion 10e of the rod portion 10a of the air piston 10. For this purpose, an urging insertion hole portion 17f having a recess is formed on the dispenser nozzle member 17, so that the projection of the rod portion 10a can be fitted fixedly in the urging insertion hole portion 17f. The mixing chamber 11 for generating a foam by mixing the liquid and air is formed at the upper end of the rod portion 10a and it serves also as a chamber to accommodate the said small coil spring 20. An opening hole portion 10c for allowing the foam, generated by mixing air and liquid, into a net member (to be described later) is formed at the upper center portion of the mixing chamber 11. Ribs 10d for locating the small coil spring 20 to the centered portion are radially formed around the opening hole portion 10c. A plurality of air passage portions 10*f* for guiding air in the air chamber 10*i* of the air piston 10 are radially formed below the ribs 10*d*. A seal portion 10*h* to fit to the aforesaid projecting seal portion 3*f* of the double cylinder member 3 is formed in the vicinity of the lower opening portions of the air passage portions 10*f*, so that the seal portion 10*h* can be fitted sealingly in the projecting seal portion 3*f*.

An outer air inlet check valve which operates when outer air is to be introduced is integrally provided on the upper wall of the air piston 10. This check valve is constituted by a check valve portion 10*k* incorporating a third ball 9 which is freely movable between the position indicated by the solid line and the position indicated by the broken line, an opening portion 10L which is open at the upper portion of the check valve portion 10*k* and is closed when the third ball 9 is moved upward, and a stopper portion 10*m* for holding the third ball 9 at the position indicated by the solid line to introduce the outer air through the opening portion 10L.

The rod portion 10*a* of the air piston 10 is guided to maintain a gap between its outer circumferential surface and the inner circumferential surface of an opening portion 14*d* of the small lid member 14, and through this gap outer air is introduced to the check valve accommodating the third ball 9.

Two net members 18 of about 200 meshes/inch each made of polyester fiber and having a thickness of 0.06 mm are pressure fitted one above the other with a spacer 19 therebetween in the aforesaid urging insertion hole portion 17*f* of the dispenser nozzle member 17. The diameter size of bubbles of the foam is governed by the mesh size of the net member 18 and when the bubbles having a random diameter in the mixing chamber portion 10*b* pass through the net member 18, they are changed to be fine uniform bubbles and dispensed through a hole portion 17*b* and a nozzle hole portion 17*a* of the dispenser nozzle member 17. The net members 18 may be of one-piece construction and may also be made of a nylon, polyethylene, polypropylene, or carbon fiber, or a stainless steel wire. Nets each having 20 to 400 meshes/inch and a thickness of 0.01 to 2 mm may be used and nets each having 50 to 300 meshes/inch and a thickness of 0.03 to 0.5 mm are more preferable.

In place of the net members 18, disk-like sheet members made of a thermoplastic resin, e.g., polyethylene or polypropylene, by injection-molding, each having a multiple of 0.03 to 0.5 mm pores and a thickness of 0.01 to 2 mm, or sintered bodies or etched metal plates each having the pores and thickness similar to those as aforesaid may be used.

An outer thread portion 17*d* having the externally threaded portion is formed on the outer surface of the urging insertion hole portion 17*f* of the dispenser nozzle member 17. The outer thread portion 17*d* can be sealingly threadably engaged with the internally threaded inner thread portion 14*a* of the small lid member 14, so that the hermetic state of container 1 can be maintained during long-term storage or transportation. For this purpose, the outer diameter of an outer circumferential portion 17*e* formed below the outer thread portion 17*d* is set slightly larger than the inner diameter of the opening portion 14*d* formed below the inner thread portion 14*a*. When the aforesaid outer thread portion 17*d* is engaged with the internally threaded inner thread portion 14*a* of the small lid member 14, the outer circumferential portion 17*e* is fitted in the opening portion 14*d*, thereby maintaining the hermetic state of the upper space of the air cylinder.

Figure 3:
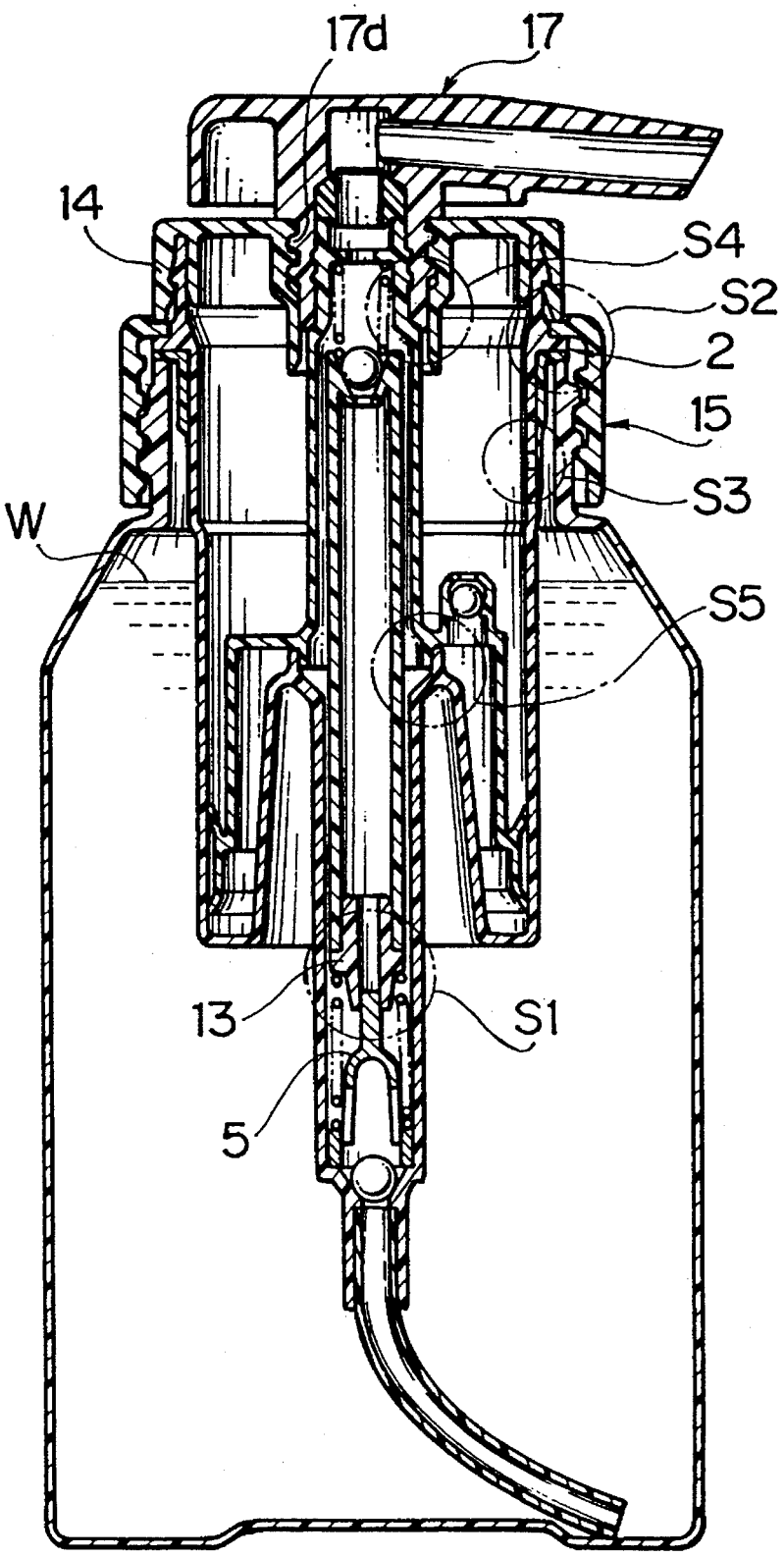
FIG. 3 is a longitudinal sectional view showing the aforesaid foam dispensing pump container which is set in a state for long-term storage or transportation.

The operation of the aforesaid arrangement will be sequentially described. FIG. 3 is a longitudinal sectional view of the aforesaid foam dispensing pump container set in a state for long-term storage or transportation.

Referring to FIG. 3, the container has the liquid up to the liquid level W, and the contacting portions of the respective components are in contact under pressure with each other sealingly so that the liquid may not leak when the container is not in use during transportation or display at a shop. To obtain this state, the nozzle member 17 is urged down to the small lid member 14 against the repelling force of the coil spring 6 and rotated to engage its outer thread portion 17*d* with the inner thread portion 14*a*.

As a result, a first seal portion S1 where the plug portion 5*a* of the plug member 5 is fitted in the liquid guide hole portion 13*b* of the slidable member 13 fixed to the liquid piston 12, a fifth seal portion S5 where the projecting seal portion 3*f* of the double cylinder 3 is fitted on the seal portion 10*h* of the air piston 10, and a fourth seal portion S4 where the outer circumferential portion 17*e* of the dispenser nozzle member 17 is fitted in the opening portion 14*d* of the small lid member 14 are respectively formed.

The large lid member 15 is threadably engaged with the container 1 through the seal member 2 to form second seal portion S2. The thin tongue portion 2*b* is integrally formed with the seal member 2 to close the outer air inlet hole portion 3*g* and form a third seal portion S3. Since the container, the air cylinder and the liquid cylinder are sealed at the first to fifth seal portions, the liquid in the container may not leak during transportation or storage.

The steps of dispensing the foam from the foam dispensing pump container having the aforesaid arrangement will be described with reference to FIGS. 1 and 2. Firstly, the container is released from the long-term storage state in FIG. 3 and the dispenser nozzle member 17 is depressed downward while the liquid A is not present in the liquid guide portion 12*a* of the liquid piston 12, so that the internal pressures of the air and liquid cylinders go up and urge the first and third balls 7 and 9 upward to the positions indicated by the broken lines respectively, while only the second ball 8 stays at the position indicated by the solid line.

Subsequently, when the dispenser nozzle member 17 is released, the integral assembly of the air and liquid pistons 10 and 12 is urged upward by the repelling force of the coil spring 6. At this time, a negative pressure is created in the interior of the liquid cylinder 3*d* to close the first check valve accommodating the first ball 7 and as the pressure in the interior of the liquid cylinder 3*d* goes further down the second check valve accommodating the second ball 8 is opened and the liquid A is drawn into the liquid cylinder. Simultaneously, a negative pressure is also created in the interior of the air chamber portion 10*i* to open the third check valve accommodating the third ball 9. As a result, outer air is smoothly supplied into the air chamber portion 10*i* through the gap between the rod portion 10*a* and the opening portion 14*d* of the small lid member 14 to prepare for foam dispensing.

When the integral piston assembly is moved downward again, the outer air introduced in the air chamber portion 10*i* of the air cylinder is pressurized to close the third check valve. As a result, the air having no other escape in the air chamber portion 10*i* is further pressurized and let upward into the mixing chamber 11 through the air passage portions 10*f*. Simultaneously, the liquid A in the liquid cylinder 3*d* is also pressurized and let upward through the liquid guide portion 12*a* to open first check valve comprising the first ball, suppressing repelling force of the coil spring 20, and flows into the mixing chamber 11.

As a result, the liquid A and air are mixed in the mixing chamber 11 to generate a foam having bubbles of random diameters, which are subsequently let through the net members 18 to become foam of uniform bubbles and dispensed through the dispenser nozzle 17.

At this time, the interior of the container is set at a negative pressure due to consumption and decrease of the liquid A, so that the tongue portion 2*b* is elastically deformed outwardly to open the outer air inlet hole 3*g*, and the outer air is drawn into the upper space in the container to release it from the negative pressure. When the container is released from the negative pressure, the tongue portion 2*b* closes the outer air inlet hole 3*g*. By further reciprocal movements of the piston assembly, stable foam of a constant mixing ratio of the air to liquid is dispensed at all times in need.

Figure 5:
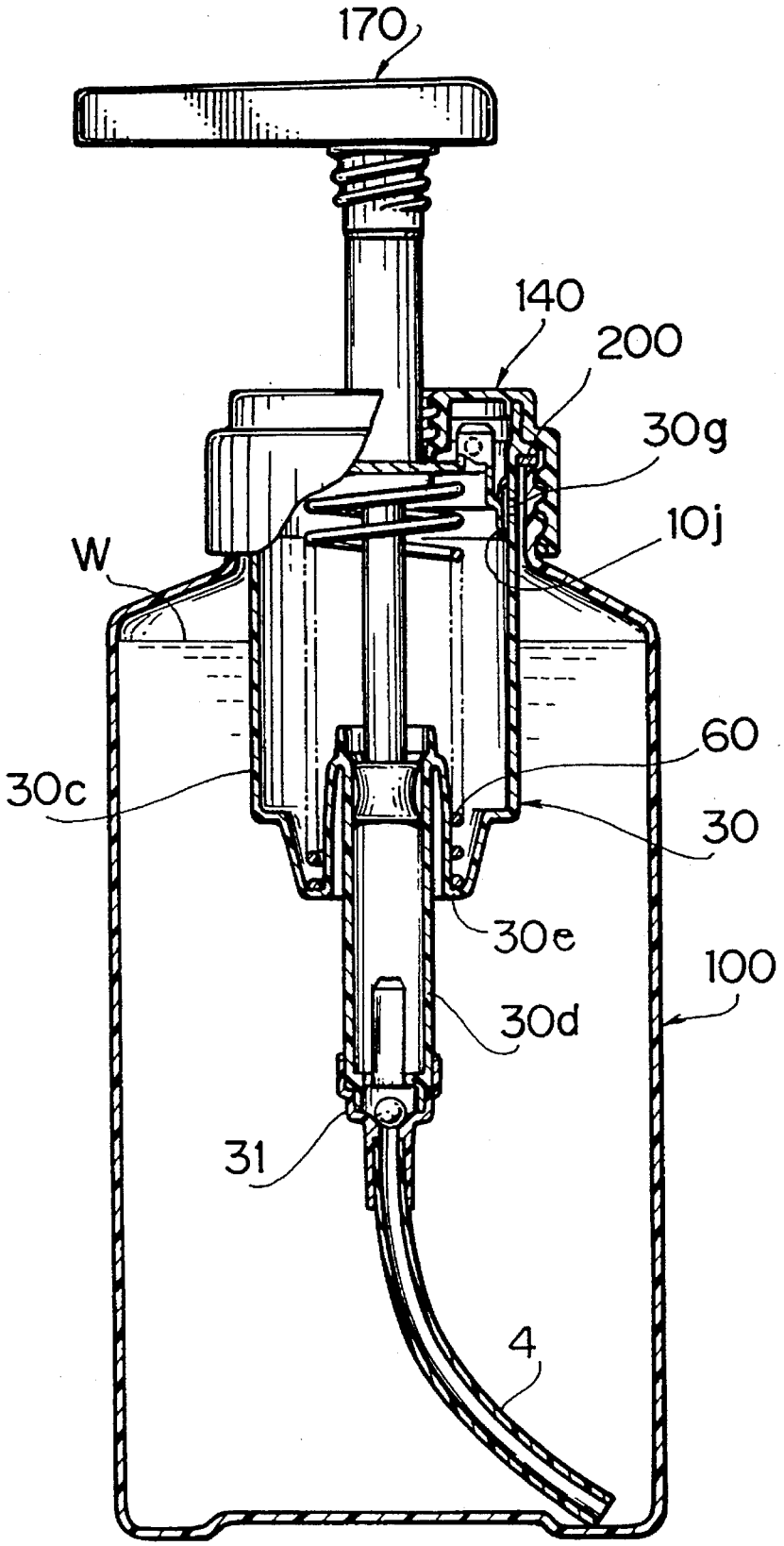
FIG. 5 is a longitudinal sectional view showing a foam dispensing pump container according to the second embodiment.

FIG. 5 is a longitudinal sectional view showing the second embodiment of a foam dispensing pump container. Since the basic arrangement of the second embodiment is substantially the same as that of the first embodiment, only different portions will be described. Referring to FIG. 5, a lid member 140 has functions to serve as a guide hole for guiding a dispenser nozzle member 170 and same time threadably engage the dispenser nozzle member 170 with a container 100. A coil spring 60 is provided not in a liquid cylinder 30*d* but in an air cylinder 30*c*. The aforesaid outer air inlet hole portion now identified as 30*g* is sealed by a slidable seal portion 10*j* of an air piston. Provided at the bottom portion of the liquid cylinder 30*d* is an urging insertion component 31 for accommodating and holding a second ball 8 and holding a pressure fitted dip tube 4. In the second embodiment having the aforesaid arrangement, stable foam with a constant mixing ratio of air to liquid can be dispensed by reciprocal movement of the piston assembly.

As has been described above, according to the present invention, there is provided a foam dispensing pump container in which the resistance in introducing outer air is kept to a minimum to ensure smooth reciprocal movement of the piston assembly, the net member or the porous member may not be clogged with a dried and solidified liquid component of the foam remaining therein, and the quantity of air introduced into the air cylinder always remains constant to maintain a given mixing ratio of liquid and air.

There is also provided a foam dispensing pump container in which the nozzle member can be threadably engaged with the lid member to maintain the hermetic state of the container when the container is not in use.

Since air is introduced into the air cylinder from the outside of the container, no extra space is needed in the upper portion of the container, and the container can carry the liquid up to a level close to the outer air inlet hole in the upper portion of the cylinder.

As has been described above, foam is generated in the mixing chamber 11 and then homogenized by the sheet-like net members 18. Therefore, even if clogging is caused in the net members 18 by an unpredictable cause after dispensing the foam, the clogging is readily cleared as the sheet-like net members 18 are thin and the clogging substance is dissolved in the subsequent foam dispensing operation by the liquid constituting the foam. In addition, since introduction of outer air is performed through the gap, it does not adversely affect the reciprocal movement of the piston assembly at all.

The inventor's experiment by removal of the sheet-like net members 18 has shown that bubbles of the foam generated in the mixing chamber 11 have random diameter sizes.

Assume that the aforementioned foam dispensing pump container is left to stand in an unlocked state in which the locked state is released to set the container in an operative state with the nozzle member and the piston assembly being set at upper positions. In this case, the following phenomena have occurred.

More specifically, assume that the foam dispensing pump container is left to stand day and night in a room where a change in ambient temperature is large, or the container is moved to a toilet to be stored after it is used in a heated room. In this case, since the container is subject to a temperature change of 10° C. or more, foam having a desired mixing ratio of air to the liquid cannot be obtained, or the aforementioned "liquid leakage" or "idling operation" is caused.

That is, when the ambient temperature at which the container is used rapidly increases from, e.g., 5° C. to 20° C., the pressure in the container begins to increase. The air in the container cannot escape outside because the outer air inlet hole 30G is closed by the thin tongue portion 2*b* of the seal member 2. For this reason, the internal pressure further increases to cause the liquid to move upward in the liquid guide portion 12*a*. As a result, the check valve ball 7 is pushed upward, and the liquid flows backward in the air flow path 10*f* to be stored in the air chamber portion 10*i* of the air cylinder.

If this storage amount increases, the stored liquid is supplied, in the subsequent operation, to the mixing chamber 11 through the air flow path 10*f* together with air to be supplied, thus changing the state of foam to be generated. As a result, foam (wet foam) in which the mixing ratio of the liquid to air increases is obtained. In the worst case, the air chamber portion 10*i* is filled with the liquid, and only the liquid is supplied to the mixing chamber 11 in the subsequent operation. As a result, no foam may be generated, or the liquid may leak out from the foam path 17*a* through the mixing chamber 11 after the container is left to stand, i.e., "liquid leakage" may occur.

Assume that the ambient temperature rapidly decreases. In this case, the thin tongue portion 2*b* is deformed to open the outer air inlet hole 30G so as to prevent the creation of a negative pressure in the container. If, however, the negative pressure in the container is not large enough to deform the thin tongue portion 2*b*, the outer air inlet hole 30G is not opened. During this period, the container is kept at a negative pressure. For this reason, unless the sealing property of the check valve ball 8 at the lower end of the liquid cylinder is perfect, the liquid in the cylinder portion 3*d* is drawn into the container. As a result, in the subsequent foam dispensing operation, the amount of liquid drawn decreases, and the discharge amount of foam decreases. In some case, no liquid may be discharged, i.e., an "idling operation" may be performed.

In addition, since the check valve ball 8 of the liquid cylinder is held by its own weight, it is moved into the cylinder by a slight negative pressure in the container.

The main characteristic feature of a foam dispensing pump container according to the third embodiment is that a released state in which the interior of the container communicates with the outside of the container through an outer air inlet hole is reliably set while the container is in an unlocked state or an operative state, thereby preventing a change in pressure in the container that may otherwise be caused by ambient temperature.

The foam dispensing pump container according to the third embodiment of the present invention will be described below with reference to FIGS. 8 and 9, in which the same reference numerals denote the same parts as those described above. Note that the same reference numerals denote the same parts throughout the drawings, and a description thereof will be omitted.

Figure 6:
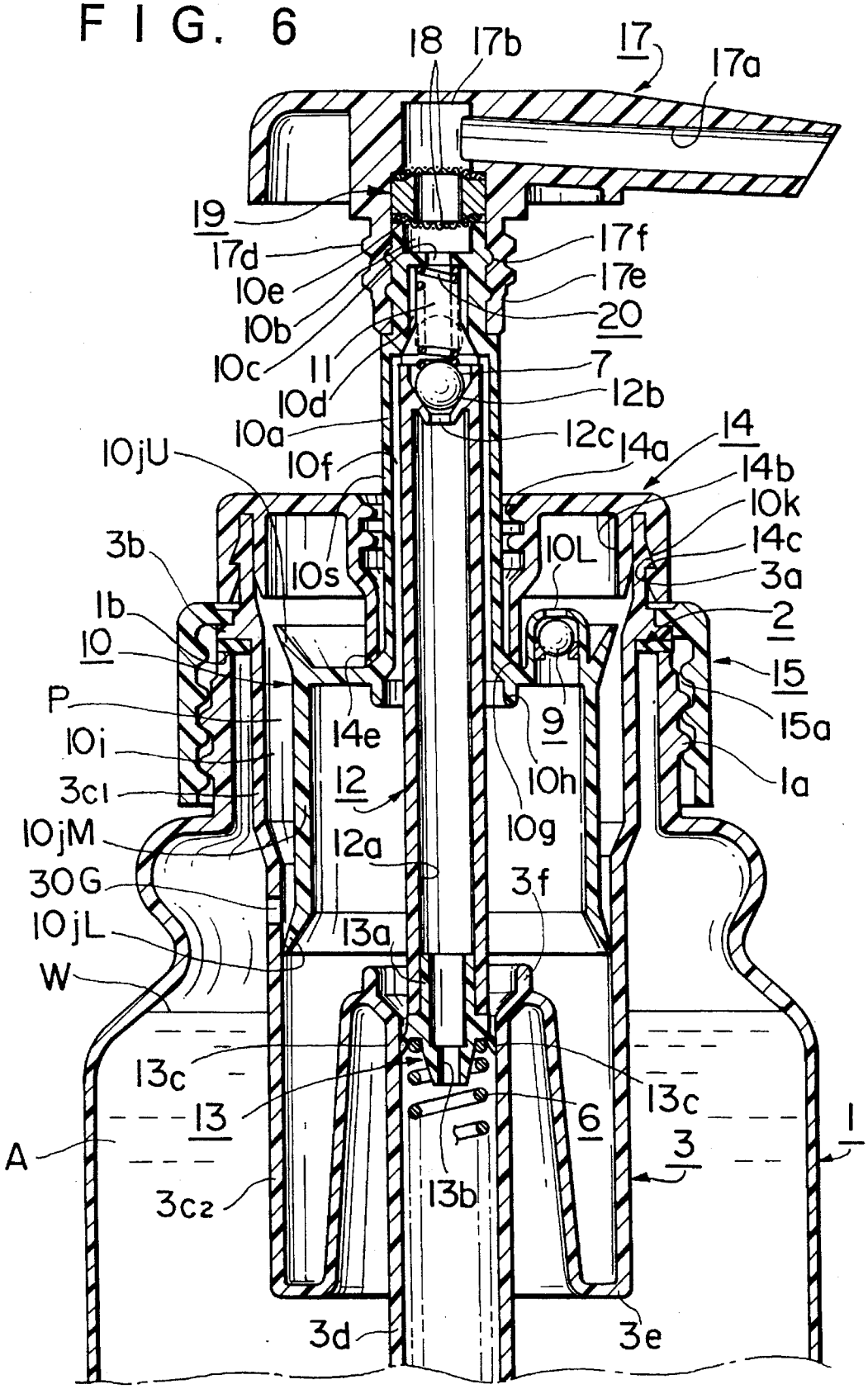
FIG. 6 is a longitudinal sectional view showing an upper portion of a foam dispensing pump container according to the third embodiment of the present invention.

Referring to FIG. 6, which is a longitudinal sectional view of the upper half of the foam dispensing pump container, an outer air inlet hole 30G is formed not in a portion of a guide cylindrical portion $3c_1$ of an air cylinder 3*c* but in an upper portion of a cylinder portion $3c_2$, unlike the first and second embodiments. In addition, the outer air inlet hole 30G is not designed to be opened/closed by the thin tongue portion 2*b* formed the annular portion extending downward from the seal member 2 as in the first and second embodiment, but is designed to be always open, and a seal member 2 is provided only for the purpose of sealing a double cylinder 3 and a container 1.

The dimensional relationship between the inner diameters of the guide cylindrical portion $3c_1$ of the air cylinder 3*c* and the cylinder portion $3c_2$ formed thereunder is almost the same as that in the first and second embodiments. However, the slidable seal portion of an air piston 10 is integrally formed from upper and lower portions of the outer circumferential surface of the air piston 10 such that the seal portion is divided into upper and lower portions 10*j*U and 10*j*L, as shown in FIG. 6. The outer diameter of each of the upper and lower portions 10*j*U and 10*j*L is set to be smaller than the inner diameter of the guide cylindrical portion $3c_1$ but is larger than the inner diameter of the cylinder portion $3c_2$. With this arrangement, the sealed state between the upper and lower portions 10*j*U and 10*j*L and the cylinder portion $3c_2$ can be maintained.

In the first and second embodiments, the slidable seal portion 10*j* is located and shaped such that it never seals the outer air inlet hole 30G regardless of whether the container is in a locked or unlocked state. In the third embodiment, however, the lower portion 10*j*L of the slidable seal portion moves up and down while it is always in sealing contact with the cylinder portion $3c_2$, and is formed at a position where it never moves beyond the outer air inlet hole 30G. On the other hand, the upper portion 10*j*U of the slidable seal portion is formed at the upper end of an intermediate portion 10*j*M of the slidable seal portion, as shown in FIG. 6, so that in the locked state of the container as shown in FIG. 8, the upper portion 10*j*U is in sealing contact with the cylinder portion $3c_2$ and the interior of the container is not communicated with outer air through the outer air inlet hole 30G, but in the unlocked state or the operative state of the container, the interior of the container is always communicated with outer air through an air flow path P formed between the upper portion 10*j*U and the intermediate portion 10*j*M of the slidable seal portion. It should be noted that the upper portion 10*j*U may be so positioned that in the operative state it opposes a transitional taper portion between the air cylinder portion $3c_2$ and the guide cylindrical portion $3_{c1}$.

The shapes of the upper and lower portions 10*j*U and 10*j*L of the slidable seal portion are not limited to those shown in FIG. 6 and as long as the outer diameter of the intermediate portion 10*j*M can be set to be smaller than the inner diameter of the cylinder portion $3c_2$, so as to adequately form the air flow path P, the upper and lower portions 10*j*U and 10*j*L may have any shapes to ensure adequate sealing performance.

Figure 9A:
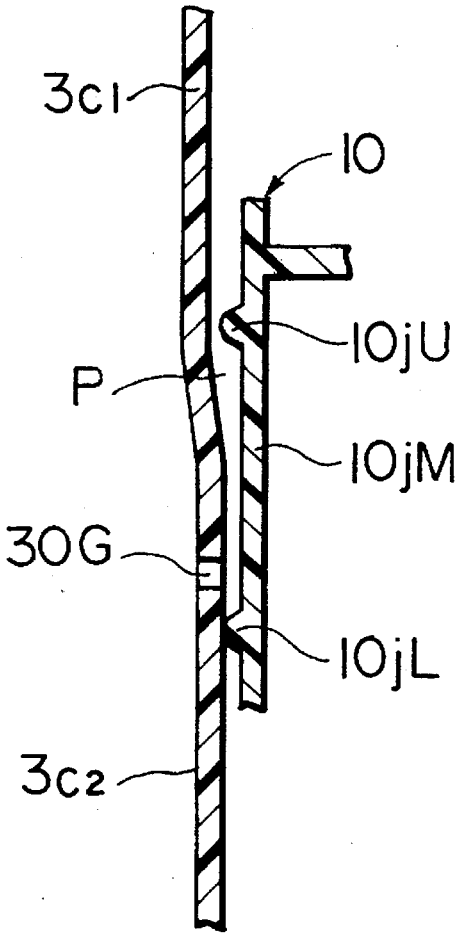
FIGS. 9A and 9B are partial cutaway views of a slidable seal portion of an air piston of the foam dispensing pump container in FIG. 6.
Figure 9B:
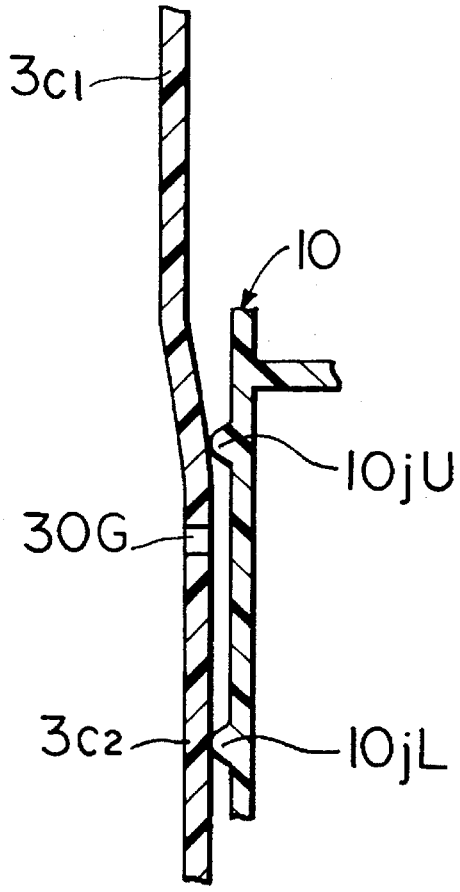

FIGS. 9A and 9B show examples of the shapes of the upper and lower portions 10*j*U and 10*j*L of the slidable seal portion. FIG. 9A shows an operative state. FIG. 9B shows a locked state during storage. Referring to FIGS. 9A and 9B, the upper portion 10*j*U of the slidable seal portion is formed on an upper portion of the outer circumferential surface of the air piston 10 in the form of a projection. Similarly, the lower portion 10*j*L of the slidable seal portion is formed on a lower portion of the outer circumferential surface of the air piston 10 in the form of a projection.

With the aforementioned arrangement, in the operative state shown in FIG. 9A, the air flow path P is reliably formed. In the locked state for storage and transportation, shown in FIG. 9B, the outer air inlet hole 30G may be sealed.

When the foam dispensing pump container having the aforementioned arrangement is set in an operative state, the interior of the container 1 communicates with the outside thereof through the outer air inlet hole 30G, the air flow path P, a groove 14*e*, and the gap between the inner circumferential surface of a small lid opening portion 14*d* and the outer circumferential surface of an air piston rod portion 10*a*. Therefore, even if the ambient temperature greatly changes, no change occurs in the internal pressure of the container 1.

This prevents a standing liquid in the air cylinder to prevent an operation of dispensing only the liquid in the use of the container and prevent "liquid leakage" when the container is left to stand. As a result, foam of a constant mixing ratio of air to the liquid can be dispensed. In addition, an "idling operation" can be prevented.

Figure 8:
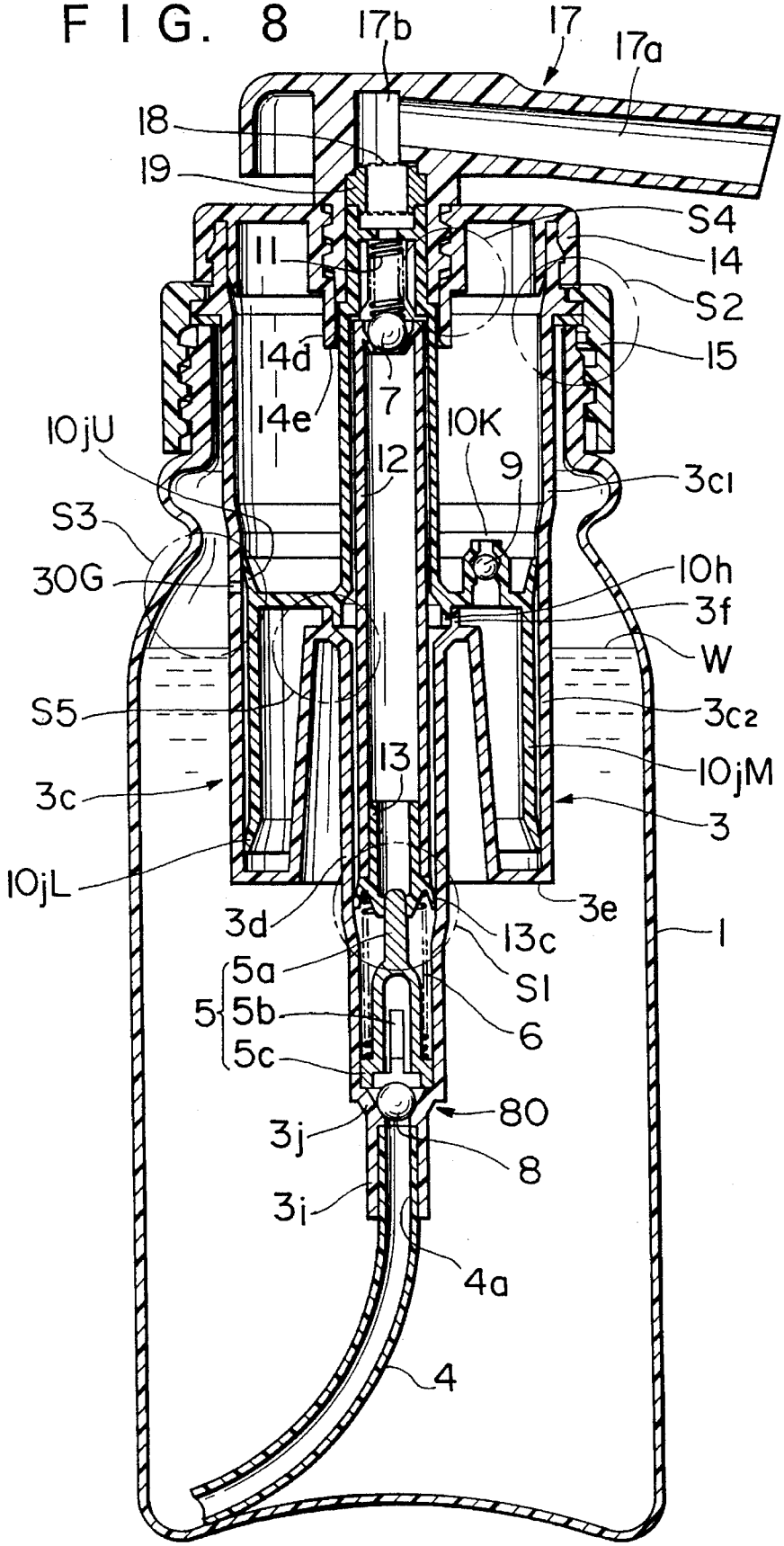
FIG. 8 is a longitudinal sectional view showing the foam dispensing pump container in FIG. 6 in a state for long-term storage or transportation.

FIG. 8 is a longitudinal sectional view showing an inoperative state of the foam dispensing pump container which is set in a state for long-term storage or transportation.

Referring to FIG. 8, a liquid is stored in the container up to a level W, and the contact portions between the respective components are brought into contact with each other under pressure to ensure a hermetic state, thereby preventing the liquid from leaking during an inoperative period, e.g., transportation or display at a shop. In order to attain this state, a nozzle member 17 is urged against a small lid member 14 against the biasing force of a coil spring 6 and is pivoted to threadably engage an outer thread portion 17*d* with an inner thread portion 14*a*.

As a result, a plug portion 5*a* of a plug member 5 is fitted in a liquid guide hole portion 13*b* of a slidable member 13 fixed to a liquid piston 12 so as to form a first seal portion S1. Similarly, a seal projection portion 3*f* of the double cylinder 3 is fitted in a seal portion 10*h* of the air piston 10 to form a fifth seal portion S5, and an outer circumferential portion 17*e* of the nozzle member 17 is fitted in the small lid opening portion 14*d* of the small lid member 14 to form a fourth seal portion S4.

Meanwhile, a large lid member 15 is threadably engaged with the container 1 through the seal member 2 to form a second seal portion S2. In addition, since the air piston 10 is moved downward, the outer air inlet hole 30G is sealed by the upper and lower portions 10*j*U and 10*j*L of the slidable seal portion so as to form a third seal portion S3. With the first to fifth seal portions, a sealed state is ensured, and hence leakage of the liquid during transportation and storage of the container can be prevented. As foam, e.g., shaving foam, face-cleaning foam, or hand-cleaning foam, generated from a foamable liquid containing a surfactant, consumers tend to like foam which is uniform in size, fine in texture (i.e., having fine bubbles), and dry (foam in which the ratio of air to the liquid is high).

Many of the foamable liquids of this type have high viscosities (10 centipoise or more) because large quantities of surfactant are mixed in the liquids to increase the cleaning power.

According to the experiences of the applicant of the present invention and the like, when such a high-viscosity foamable liquid passes through the mixing chamber and the porous sheet together with air, the air is not easily mixed in the foamable liquid, and hence nonuniform foam having large bubbles tends to be generated.

Assume that nets of 200 meshes/inch serving as porous sheet-like members, each formed by weaving a polyester yarn having a thickness of 0.06 mm, are arranged at intervals of 5.0 mm in the insertion hole portion 17*f* of the foam dispensing pump container shown in FIG. 6, and a foamable liquid having a viscosity of 10 centipoise (10 cp) is stored in the container to generate foam. In this case, the generated fine foam has only a small number of large bubbles. If, however, a foamable liquid having a viscosity of 20 centipoise (20 cp) is used, a considerably larger number of large bubbles are included in the foam. Such foam is not suitable for shaving foam or face-cleaning foam.

Japanese Patent Laid-Open No. 53-40404 (U.S. Pat. No. 2,419,159) discloses an invention associated with a foaming device used together with a trigger type dispenser or a finger pump type dispenser.

According to this disclosure, a foamable liquid and air are mixed with each other in a mixing chamber to generate foam, and the foam is caused to pass through a foam generating chamber having a diameter smaller than the mixing chamber to compress the foam, thus forming foam having a finer texture. Thereafter, the foam is caused to collide with one to three screens (nets) to promote the foaming action and make the foam finer. In addition, it is described in this disclosure that when two screens (nets) are to be used, they should be separated from each other by at least a distance of 0.0787 cm in order to facilitate the formation of foam having a fine texture. It is also described that if the screens are too close to each other, they act like one screen, and if the screens are too far from each other, the flow of foam is retarded, and the foam begins to collapse before it passes through the device. Furthermore, it is described in this official gazette that a property of generated foam, i.e., whether it is wet or dry, is mainly determined by a function of the ratio of air to a liquid and is governed by the liquid passing through an orifice and the air passing through a groove hole and the size of a mixing chamber.

In the disclosure of the official gazette, however, no reference is made to a desired mesh size of a screen (net) or to a desired distance between two screens.

Japanese Utility Model Publication No. 63-13810 discloses a foam dispensing pump container having a foaming device at an opening portion of an elastic container body. The invention disclosed in this official gazette is made in consideration of the following problem. Assume that the pores of a porous member through which a foamable liquid and air are caused to pass simultaneously are reduced in size. In this case, it is difficult for outer air to pass through the porous member when the depressed and sunken container body restores. For this reason, it takes time for the container body to restore, and inconvenience is caused when foaming is continuously performed several times. It is described that this problem is solved by arranging a porous plate on the upstream side of the foaming device and a net or unwoven cloth on the downstream side of the porous plate. That is, with this arrangement, coarse foam is generated first through the porous plate, and this foam is made finer through the net or unwoven cloth.

In this official gazette, there is no detailed description of the distance between the porous plate and the net or unwoven cloth, or a detailed description of the size of the pores of the porous plate and a mesh size.

Japanese Patent Laid-Open No. 2-237671 (corresponding to U.S. Pat. No. 5,071,379) discloses the invention associated with a foam generating device used for a foam dispensing pump container having a flexible container body. According to this official gazette, the size of a path or an opening portion of a mesh of a screen used to generate foam can be changed in a wide range of about 10 μm to 250 μm, and a path having a larger size is selected as the viscosity of a liquid to be used increases.

In addition, in the official gazette, as an example of the arrangement of three screens, a screen having a 120-μm opening portion is placed at the first partition wall on the uppermost side, a screen having a 90-μm opening portion is placed at the second partition wall, and a screen having a 70-μm opening portion is placed at the third partition wall.

In the official gazette, however, there is no detailed description of the distances between the respective screens.

Figure 7:
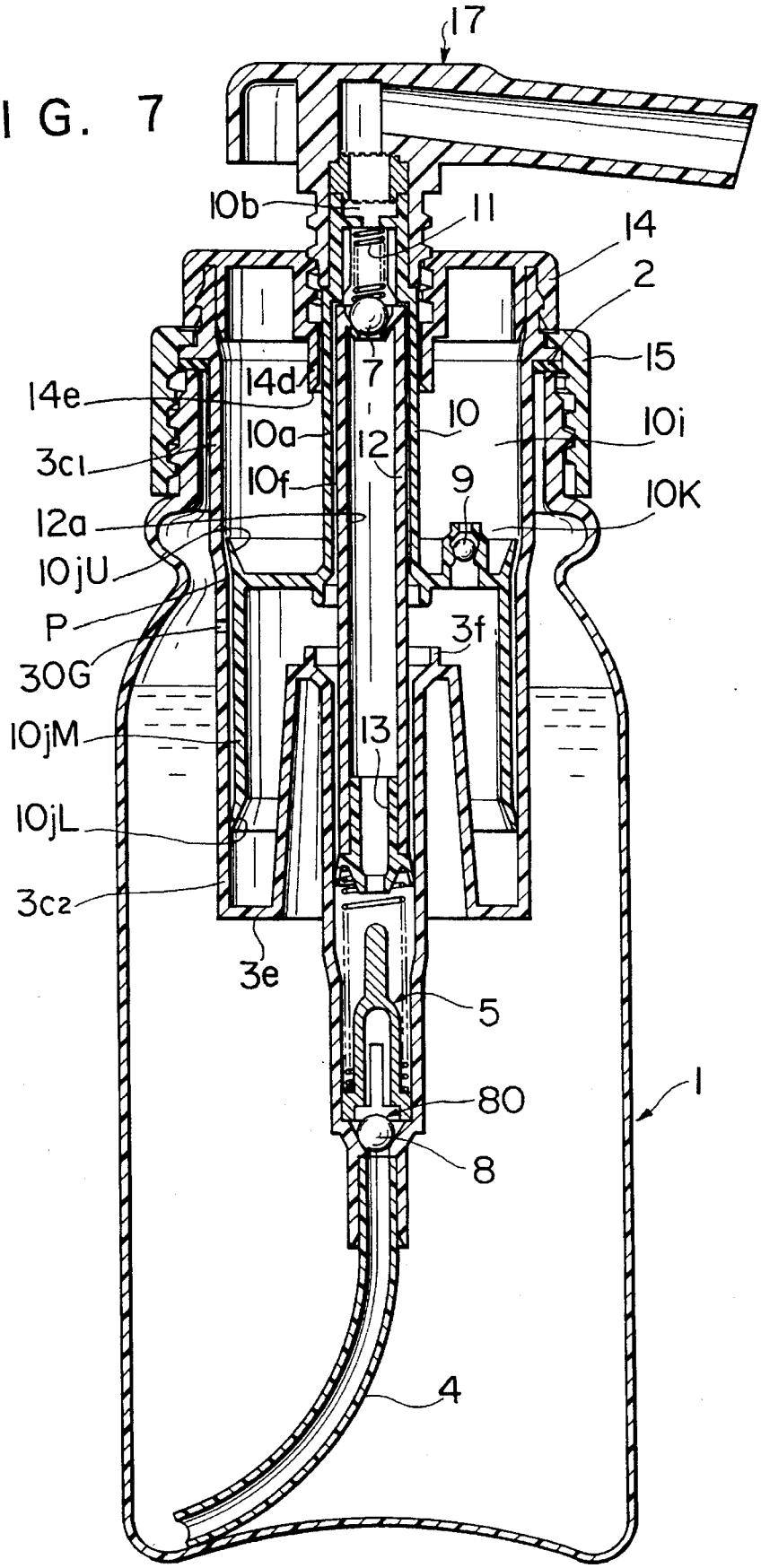
FIG. 7 is a longitudinal sectional view showing a state of the foam dispensing pump container in FIG. 6 in use.

According to the research performed by the applicant of the present invention, in the foam dispensing pump container having the arrangement shown in FIGS. 6 to 8, fine uniform foam could be generated by using a foamable liquid having a viscosity of 10 centipoise or more with the following arrangement and settings. Two or more porous sheet-like members were arranged. The distance of two members of these porous sheet-like members was set to be 10 mm or more. The area of each pore of the porous sheet-like member on the upstream side was set to be 0.10 $mm^2$ or more, while the area of each pore of the porous sheet-like member on the downstream side was set to be 0.015 $mm^2$ or less. In addition, the size of each pore of the porous sheet-like member on the downstream side was set to be 60% or less of that of each pore of the porous sheet-like member on the upstream side.

Especially, it was found that the following settings were preferable to generate fine uniform foam by using a foamable liquid having a high viscosity. The distance between the two porous sheet-like members was set to be 12 to 60 mm. The area of each pore of the porous sheet-like member on the upstream side was set to be 0.0023 to 0.04 $mm^2$, while the area of each pore of the porous sheet-like member on the downstream side was set to be 0.0007 to 0.007 $mm^2$. In addition, the size of each pore of the porous sheet-like member on the downstream side was set to be about 60% or less of that of each pore of the porous sheet-like member on the upstream side.

The fourth embodiment of the present invention will be described below with reference to FIGS. 10, 11A, and 11B.

Figure 10:
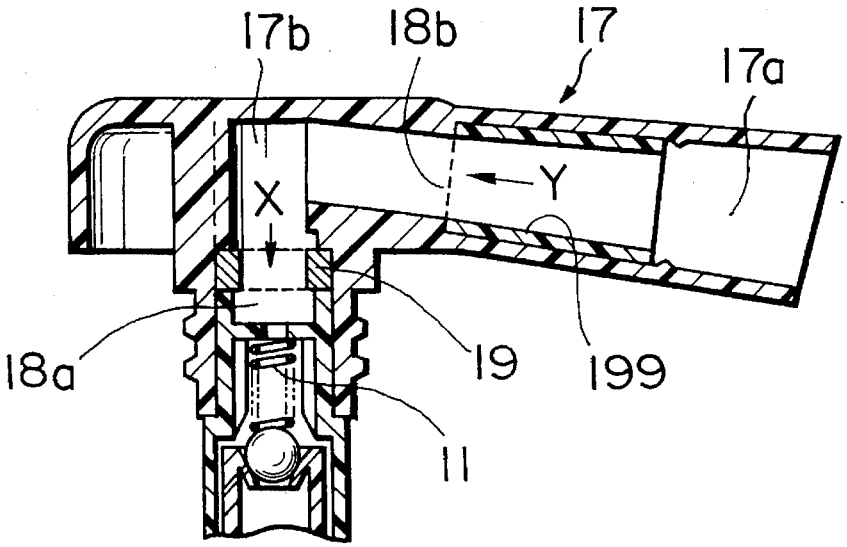
FIG. 10 is a longitudinal sectional view showing a foam dispensing nozzle member of a foam dispensing pump container according to the fourth embodiment of the present invention.
Figure 11A:
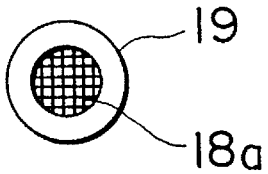
FIGS. 11A and 11B are front views showing a porous sheet-like member when the foam dispensing nozzle member in FIG. 10 is viewed from the X and Y directions, respectively.
Figure 11B:
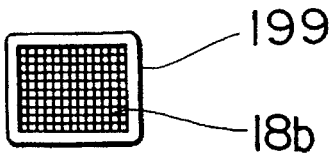

FIG. 10 is a longitudinal sectional view showing the structure of part of a nozzle member which is improved to foam a foamable liquid having a high viscosity. FIGS. 11A and 11B are front views showing porous sheet-like members on the upstream and downstream sides, respectively.

Since the structure of the container of this embodiment is the same as that shown in FIGS. 6 to 8 except for an improved main portion, a description thereof will be omitted, and the characteristic structure of the fourth embodiment will be mainly described below.

As is apparent from FIG. 10, two porous sheet-like members (net members) having pores of different sizes, i.e., a porous sheet-like member (net member) 18*a* on the upstream side and a porous sheet-like member (net member) 18*b* on the downstream side are arranged in a hole portion 17*b* and a foam path 17*a* of the nozzle member 17 on the downstream side of the mixing chamber 11 of the foam dispensing pump container shown in FIGS. 6 to 8 so as to be spaced apart from each other by a predetermined distance (10 mm or more).

As these porous sheet-like members, members formed by weaving a synthetic fiber such as a polyester, nylon, polyethylene, or polypropylene fiber are suitable for the following reasons. Such porous sheet-like members are thin and have low resistance with respect to a foamable liquid passing therethrough. They rarely clog and are not easily torn. In addition, they can be thermally welded on spacers 19 and 199 (described above).

As the porous sheet-like member 18*a* on the upstream side, a member formed of a synthetic resin such as polyester, nylon, polyethylene, or polypropylene by injection molding, e.g., a molded member integrally formed with a spacer, may be used.

The sheet-like member 18*a* on the upstream side is thermally welded to the spacer 19 formed of a material of the same type as that for the sheet-like member 18*a* by injection molding and is held by the distal end of a piston assembly fitted in the hole portion 17*b* of the nozzle member 17. Note that the spacer 19 was formed into a ring-like shape, and the area of each opening thereof was set to be 12.6 $mm^2$ (ϕ4 mm). This is because the resistance to foam passing through each pore is undesirably increased if its area is too small.

The porous sheet-like member 18*b* on the downstream side is also thermally welded to the spacer 199 formed of a material of the same type as that for the sheet-like member 18*b*, and is fitted in the foam path 17*a* of the nozzle member 17. Each opening of the spacer 199 is formed into a square shape, and its area is set to be as large as possible, thereby preventing an increase in resistance to a liquid passing through the porous sheet-like member having small pores. In this embodiment, the area of each opening of the spacer 199 was set to be 26 $mm^2$.

It was found from the experiment results to be described later that it was important to set the size of each opening portion of the two porous sheet-like members and the distance therebetween as follows. In consideration of the uniformity of foam, the size of each opening portion of the porous sheet-like member 18*a* on the upstream side near the mixing chamber 11 was preferably set to be 0.10 $mm^2$ or less, and preferably 0.023 to 0.04 $mm^2$. With this setting, the resistance to foam passing through the net member is reduced, and fine uniform foam can be generated.

In order to generate fine foam, the size of each opening portion of the sheet-like member 18*b* on the downstream side is preferably set to be 0.015 $mm^2$ or less, and more preferably 0.0007 to 0.007 $mm^2$. With this setting, clogging due to a foamable liquid, minute dust in the container, and the like does not easily occur, and the resistance to foam passing through each pore is not increased, thus obtaining fine foam. In addition to this setting, mixing of large bubbles can be prevented by setting the size of each pore of the porous sheet-like member 18*b* on the downstream side to be 60% or less of that of each pore of the porous sheet-like member 18*a* on the upstream side.

Furthermore, the distance between the two porous sheet-like members 18*a* and 18*b* is set to be 10 mm or more, and preferably 12 mm or more, in consideration of the uniformity of foam. With this setting, uniform foam without large bubbles can be obtained. Note that the foam path 17*a* of the nozzle member 17 located on the downstream side of the porous sheet-like member 18*b* on the downstream side is not narrowed down but is slightly expanded toward the outlet port at the distal end of the nozzle member, thereby further reducing the resistance to foam passing therethrough and preventing foam from being discharged too forcibly.

In the aforementioned embodiment, the two porous sheet-like members are used. However, three sheet-like members may be used. For example, a porous sheet-like member 18*c* (not shown) having finer pores than the porous sheet-like member 18*b* may be arranged on the downstream side of the sheet-like member 18*b* on the downstream side, while the size of each pore of the sheet-like member 18*c* is set to be 60% or less of that of each opening portion of the sheet-like member 18*b*. In this case, although the force required to push down the nozzle increases, fine uniform foam can be generated by using a foamable liquid having a higher viscosity.

The experiment results obtained by using the foam dispensing pump container of this embodiment will be described next. The foamable liquid used in the experiment was a face-cleaning agent having a viscosity of about 20 centipoise (20 cp). This viscosity was measured by a BL type viscometer (TOKIMEC INC.) at a liquid temperature of 25° C. The speed at which the nozzle is pushed down influences the quality of foam and the force required to push down the nozzle. For this reason, in the experiment, the nozzle was pushed down by a special machine at a constant speed of 3 m/min (close to the speed at which the nozzle is generally pushed down with the hand). The ambient temperature in the experiment was 25° C.

In order to check the relationship between the sizes of the pores of the two porous sheet-like members 18*a* and 18*b*, nine porous sheet-like members having pores of different sizes, ranging from 0.0007 to 0.16 $mm^2$, were prepared for each of the two porous sheet-like members, and 81 combinations, the total number of combinations (nine sheet-like members on the upstream side×nine sheet-like members on the downstream side), were subjected to the experiment to check the fineness and uniformity of foam. The distance between the two porous sheet-like members 18*a* and 18*b* was set to be 20 mm.

The result is shown in FIG. 12, which is a chart showing the relationship between the areas of the pores of the two porous sheet-like members and the quality of foam. Referring to FIG. 12, the range enclosed with the thick line indicates preferable combinations.

The value at an upper portion of each column for the sheet-like members 18*b* and 18*a* indicates the area ($mm^2$) of each pore of a porous sheet-like member. The value in parentheses indicates the total area ($mm^2$) of the pores of each porous sheet-like member.

In addition, the sign at an upper left portion of each column indicates the fineness of foam. More specifically, "×" indicates that foam is coarse; "Δ" indicates that foam is slightly coarse; and "○" indicates that foam is fine. Furthermore, the sign at an lower right of each column indicates the uniformity of foam. More specifically, "×" indicates that foam has large bubbles; "Δ" indicates that foam has slightly large bubbles; and "○" indicates that foam is uniform. As is apparent from this chart, the combinations in the range enclosed with the thick line are preferable combinations.

Almost good foam was obtained with the following combinations of the sizes of pores of porous sheet-like members. The size of each pore of the porous sheet-like member 18*a* on the upstream side was 0.10 $mm^2$ in consideration of the uniformity of foam. The size of each pore of the porous sheet-like member 18*b* on the downstream side was 0.015 $mm^2$ in consideration of the fineness of foam. In addition, the size of each pore of the porous sheet-like member 18*b* on the downstream side was smaller (about 60% or less in the experiment) than that of each pore of the porous sheet-like member 18*a* on the upstream side.

Of these combinations, the following combination maximized the force required to push down the nozzle. The size of each pore of the porous sheet-like member 18*a* on the upstream side was 0.0015 $mm^2$. The size of each pore of the porous sheet-like member 18*b* on the downstream side was 0.0007 $mm^2$. Although a slightly larger value than 3.3 Kg was recorded as the force required, the value fell within a practicable range.

The distance between the porous sheet-like member 18*a* on the upstream side and the porous sheet-like member 18*b* on the downstream side was changed to check the relationship between the distance and the uniformity of foam. FIG. 13 shows the experiment result. When the distance was set to be at least 10 mm or more, almost uniform foam was obtained. Especially when the distance was set to be 12 to 60 mm, very uniform foam was obtained. This experiment was conducted with a combination of 0.04 $mm^2$ for the porous sheet-like member 18*a* on the upstream side and 0.007 $mm^2$ for the porous sheet-like member 18*b* on the downstream side.

From this experiment, the result shown in FIG. 13 was obtained as the relationship between the distance between the porous sheet-like member 18*a* and the porous sheet-like member 18*b* and the uniformity of foam. More specifically, "×" indicates that foam has large bubbles; "Δ" indicates that foam has slightly large bubbles; and "○" indicates that foam is uniform. Even if the distance between the two porous sheet-like members 18*a* and 18*b* exceeds 60 mm, it is expected that uniform foam can be obtained. However, if the distance is set to be too large, the length of the nozzle member 17 must be increased, resulting in an increase in cost. Therefore, the distance between the porous sheet-like members 18*a* and 18*b* is preferably set to be 60 mm or less.

Note that the foam dispensing pump container of this embodiment can generate very fine foam even by using a foamable liquid having a low viscosity of about 4 centipoise.

The preferred embodiments of the present invention have been described in detail with reference to the accompanying drawings but it is to be understood that the practical arrangement is not limited to these specific embodiments, and that various design changes may be made without departing from the spirit and scope of the present invention.

What is claimed is:

1. A foam dispensing pump container comprising a double cylinder which is provided inside an opening portion of a container containing a liquid and which is constituted by an air cylinder for pumping air and a liquid cylinder for pumping a liquid, a dip tube for allowing a bottom portion of said liquid cylinder and a bottom portion of said container to communicate with each other, a piston assembly constituted by air and liquid pistons provided to move reciprocally in said air and liquid cylinders respectively, a nozzle member provided at an upper end of said piston assembly and having a foam dispensing hole portion, an air flow path for allowing said hole portion and an interior of said air cylinder to communication with each other, a liquid flow path for allowing an interior of said liquid cylinder and said hole portion to communicate with each other, a first check valve disposed along said liquid flow path, a second check valve disposed in said liquid cylinder, a porous member disposed in said hole portion, a compression spring for urging said piston assembly to a top dead point with respect to said double cylinder, an outer air inlet hole to allow the liquid in said container and outer air outside said container to communicate with each other to prevent the interior of said container from being set at a negative pressure, and a lid member for fixing said double cylinder to said container, a juncture where said liquid flow path and said air flow path join with each other on an upstream side of said porous member to serve as a mixing chamber for mixing the liquid and air, a third check valve disposed in said air piston, a first threaded portion being formed on an outer circumferential surface of said nozzle member and a second threaded portion being formed on said lid member to threadably engage with said first threaded portion, such that a threadable engagement of said air piston and said lid member is maintainable against repelling force of said compression spring, and slidable seal portions maintaining said outer air inlet hole in a closed state when said lid member and said member are in the threadable engagement with each other and opening air communication between said air cylinder and atmosphere through said outer air inlet hole when said lid member and said nozzle member are released from the threadable engagement with each other.

2. The container according to claim 1, wherein said compression spring is disposed in said liquid cylinder.

3. The container according to claim 1, wherein said porous member comprises at least one net member having predetermined meshes and a predetermined thickness, and is disposed to homogenize bubbles of foam to have a uniform diameter.

4. The container according to claim 1, wherein said porous member comprises at least one integrally molded member having a multiple of holes of a predetermined diameter formed therein, and is disposed to homogenize bubbles of foam to have a uniform diameter.

5. The container according to claim 1, wherein said first, second and third check valves comprise ball members.

6. The container according to claim 5, wherein said ball member of said first check valve is urged by a compression spring to close said first check valve.

7. The container according to claim 1, wherein a taper portion is formed on an inner circumferential surface of said double cylinder in order to easily fit and insert said piston assembly in said double cylinder during assembly.

8. The container according to claim 1, wherein said porous member comprises at least a pair of porous sheet-like members, one being disposed on an upstream side of the other in said foam dispensing hole portion and each spaced from the other by a distance of not less than 10 mm, said sheet-like member on the upstream side having a plurality of pores in a size of opening of not greater than 0.1 $mm^2$, said other sheet-like member having a plurality of pores in a size of opening of not greater than 0.015 $mm^2$, and said pores of said other sheet-like member each being not greater than about 60% of the size of said pores of said sheet-like member on the upstream side.

9. The container according to claim 8, wherein said pair of porous sheet-like members are spaced from each other by a distance of 12 to 60 mm, said pores of said porous sheet-like member on the upstream side each has an opening in a size of 0.0023 to 0.04 $mm^2$, and said pores of said other porous sheet-like member each has an opening in a size of 0.0007 to 0.007 $mm^2$.

10. The container according to claim 8, wherein said porous sheet-like members comprise net members.

11. The container according to claim 8, wherein said porous sheet-like member on the upstream side comprises an injection-molded member and said other porous sheet-like member comprises a net member.

* * * * *

UNITED STATES PATENT AND TRADEMARK OFFICE
CERTIFICATE OF CORRECTION

PATENT NO. : 5,570,819

DATED : November 5, 1996

INVENTOR(S) : Uehira et al.

It is certified that error appears in the above-identified patent and that said Letters Patent is hereby corrected as shown below:

On the title page, in [75], line 1, "Joyo" should read --Kyoto--.

On the title page, in [75], line 2, "Yokohama" should read --Kanagawa--.

In column 6, line 11, "$3_{c2}$" should read --$3c_2$--.

In column 13, line 55, "$3_{c1}$" should read --$3c_1$--.

Signed and Sealed this

Tenth Day of June, 1997

*Attest:*

*Attesting Officer*

Bruce Lehman

BRUCE LEHMAN

*Commissioner of Patents and Trademarks*